US009790757B2

(12) United States Patent
Marzullo et al.

(10) Patent No.: US 9,790,757 B2
(45) Date of Patent: Oct. 17, 2017

(54) DEVICE FOR COVERING A PIPELINE FROM A WELLBORE

(71) Applicant: DAKEEZ FRANCE, Toulouse (FR)

(72) Inventors: Romain Marzullo, Toulouse (FR); Bernard Marzullo, Trouillas (FR)

(73) Assignee: DAKEEZ FRANCE, Toulouse (FR)

( * ) Notice: Subject to any disclaimer, the term of this patent is extended or adjusted under 35 U.S.C. 154(b) by 240 days.

(21) Appl. No.: 14/412,639

(22) PCT Filed: Jul. 5, 2013

(86) PCT No.: PCT/FR2013/051599
§ 371 (c)(1),
(2) Date: Jan. 2, 2015

(87) PCT Pub. No.: WO2014/006343
PCT Pub. Date: Jan. 9, 2014

(65) Prior Publication Data

US 2015/0136382 A1 May 21, 2015

(30) Foreign Application Priority Data

Jul. 6, 2012 (FR) ..... 12 56520
Nov. 16, 2012 (FR) ..... 12 60909

(51) Int. Cl.
*E21B 33/02* (2006.01)
*E03B 3/16* (2006.01)
*E03B 5/06* (2006.01)
*E21B 33/03* (2006.01)

(52) U.S. Cl.
CPC ..... *E21B 33/02* (2013.01); *E03B 3/16* (2013.01); *E03B 5/06* (2013.01); *E21B 33/03* (2013.01)

(58) Field of Classification Search
None
See application file for complete search history.

(56) References Cited

U.S. PATENT DOCUMENTS 2,456,081 A * 12/1948 Penick ..... E21B 33/04 277/328
2,735,697 A 2/1956 Zanin
3,018,829 A * 1/1962 Maass ..... E03B 5/06 166/85.2
3,039,532 A 6/1962 Williams
(Continued)

FOREIGN PATENT DOCUMENTS

DE 3512709 A1 10/1986
WO WO 99/43922 A1 9/1999

OTHER PUBLICATIONS

International Search Report in PCT/FR2013/051599, dated Nov. 7, 2013, 2 pages.

*Primary Examiner* — Shane Bomar
(74) *Attorney, Agent, or Firm* — Finnegan, Henderson, Farabow, Garrett & Dunner LLP

(57) ABSTRACT

A device for covering a pipeline from a wellbore comprising a cover comprising at least one lower bearing surface suitable for being mounted on an end of a vertical annular pipeline of a wellbore. The device includes a distribution elbow comprising a lower end, intended to be connected to a pipe of the wellbore, that extends vertically downwards from the cover and an upper end extending horizontally. The cover and the distribution elbow form a monobloc assembly.

13 Claims, 7 Drawing Sheets

(56) References Cited

U.S. PATENT DOCUMENTS

| | | | | |
|---|---|---|---|---|
| 3,261,403 | A * | 7/1966 | Newman | E21B 33/00 166/105 |
| 3,568,769 | A * | 3/1971 | Maass | E21B 33/03 166/75.13 |
| 4,842,060 | A * | 6/1989 | Paulus | E21B 33/00 166/85.1 |
| 7,231,968 | B2 * | 6/2007 | Owens | E21B 33/03 166/75.13 |
| 9,068,421 | B2 * | 6/2015 | Colby | E21B 33/03 |
| 2010/0294481 | A1 * | 11/2010 | Vanderford | E21B 33/03 166/75.11 |

* cited by examiner

DEVICE FOR COVERING A PIPELINE FROM A WELLBORE

CROSS-REFERENCE TO RELATED PATENT APPLICATIONS

This application is a National Stage Entry under 35 U.S.C. §371 of International Application No. PCT/FR2013/051599, filed Jul. 5, 2013, which claims priority to FR Application No. 1256520, filed Jul. 6, 2012, and to FR Application No. 1260909, filed Nov. 16, 2012.

GENERAL TECHNICAL FIELD AND PRIOR ART

The present invention relates to the field of wellbores and more particularly it concerns a device for covering a wellbore duct.

Usually, with reference to FIG. 1, to create a well on the property of a private individual so that the latter has a source of drinking water, a borehole is made at first so that a vertical cavity can be excavated vertically in the ground until a body of groundwater is reached. Thereafter, a vertical duct 1, generally made of PVC, is disposed inside the cavity to reinforce the vertical walls of the cavity. Such a vertical duct 1 has an annular cross section and its diameter varies in accordance with the borehole. Usually, the tubular duct 1 has an annular cross section of approximately 125 mm, 135 mm or 145 mm.

A water distribution pump 2 is usually disposed immersibly in the groundwater. A line pipe 3, traditionally made of semi-rigid plastic, is placed in the cavity and connected to the distribution pump 2 so as to bring a flow of water vertically from the body of groundwater to ground level.

The upper end of the duct 1 forms the head of the wellbore and it is usual to cover it using a covering device 4 that allows a connection to be made to the line pipe 3 and allows an electrical power supply cable 13 of the distribution pump 2 and a suspension cable 12 of the distribution pump 2 to pass through, as shown in FIG. 1. Preferably, a connector (not shown) is placed between the line pipe 3 and the covering device 4.

Such a covering device 4 is known to the person skilled in the art by the name "wellbore plug" and it is made of metal, preferably of steel. With reference to FIG. 2, a covering device 4 takes the form of a hemispherical cover 40 of metal with a central traversing orifice 41 for the connection of the line pipe 3 and two auxiliary traversing orifices 42, 43 for the through passage of the suspension cable 12 and the electrical power supply cable 13 as shown in FIGS. 1 and 2.

With reference to FIG. 2, the central orifice 41 usually has an internal thread 41T to allow both the line pipe 3 to be fixed from the bottom up and the fixing from the top down of a distribution elbow 44 adapted to distribute the collected water outside the borehole as shown in FIG. 1. In practice, the distribution elbow 44 and the line pipe 3 are in abutment in the Internal thread 41T of the covering device 4. Usually, a distribution valve 45 is fitted at the end of the distribution elbow 44 in order to supply water to, for example, a hosepipe (not shown).

In practice, the covering device 4 according to the prior art has several disadvantages. Firstly, because of its hemispherical shape, the covering device 4 is not stable when it is positioned on the upper end of the duct 1. The result of this is the appearance of play and premature wear of the covering device 4.

In addition, when the device 4 is put in place, it is necessary to select a device 4 whose diameter is appropriate to that of the duct 1. From a logistics point of view, a well-digger has to have a large range of covering devices 4 available, which is a disadvantage.

Then, the weight of the covering device 4 is high, which has disadvantages as regards manipulating it. Moreover, the power supply and suspension cables are pinched by the hemispherical surface of the cover when it is used, which accelerates the wear of these cables.

Furthermore, in order to access the pump during a maintenance step, it is necessary to hold the cables and the device with both hands, which is not very practical.

Moreover, the internal thread 41T of the central orifice 41 for connecting the line pipe 3 and the distribution elbow 44 are sources of play and cause leaks at the central orifice 41 which reduces the efficiency of the wellbore. Because of electrolysis phenomena, the screwed connection is subject to corrosion, which accelerates wear of the covering device 4 and increases the duration of maintenance steps, as the line pipe 3 is difficult to disconnect from the covering device 4. This is because corrosion of the distribution elbow 44 has adverse effects on the Internal thread 41T of the central orifice 41 which spread to the line pipe 3.

In addition, installation of the distribution elbow 44 requires the creation around the duct of a peripheral working cavity 7 of significant dimensions so that the well-digger can manipulate and move the distribution elbow 44 when it is fitted to the covering device 4. Such a peripheral working cavity 7 requires a significant amount of excavation work, which is a disadvantage.

U.S. Pat. No. 3,039,532 presents a covering device with a swan-neck distribution elbow and is not suitable for a standard wellbore. It requires a significant amount of excavation around the wellbore.

Documents U.S. Pat. No. 2,735,697, DE3512709A1 and WO 99/43922 present a covering device according to the prior art with a distribution pipe independent of the cover.

GENERAL PRESENTATION OF THE INVENTION

In order to eliminate at least some of these disadvantages, the invention relates to a device for covering a wellbore duct with a cover comprising at least one lower bearing surface suitable for being fitted onto an end of a vertical annular duct of a wellbore and a distribution elbow with a lower end, intended to be connected to a line pipe of the wellbore, extending vertically downwards from the cover and an upper end extending horizontally, the cover and the distribution elbow forming a monobloc assembly.

Advantageously, the distribution elbow is integrated into the cover, which reduces the space occupied by the device and also its weight, and eliminates any risk of corrosion related to the connection of the distribution elbow. In addition, the device can be installed rapidly, given that it is no longer necessary to fit the distribution elbow in the cover. Furthermore, as the distribution elbow no longer has to be manipulated independently of the cover, it is no longer necessary to carry out excavation operations as significant as those in the prior art.

The lower bearing surface is plane and horizontal, preferably annular. Thus, the cover bears in a stable manner against the upper end of the duct which limits the wear to it and improves the stability of the distribution pump.

The cover has a vertical stop wall, associated with the lower bearing surface, adapted to restrict a movement of the cover in a horizontal plane relative to the duct when the cover is bearing against the lower bearing surface.

According to an aspect of the invention, the monobloc assembly is formed by moulding and is made of rigid plastic, preferably of ABS. The weight of such a monobloc device is low, which makes it easier to manipulate. Besides its low manufacturing cost, such a monobloc assembly is unlikely to be degraded by corrosion, which is advantageous.

The cover has an upper plane horizontal surface which allows its height dimension to be reduced in order to increase its compactness. This reduces the excavation operations to create the peripheral working cavity. In addition, this allows the power supply and pump suspension cables to extend perpendicularly to the upper surface, which restricts the pinching of the cables that accelerates the wear thereof.

The upper end of the distribution elbow extends as far as the periphery of the cover. Thus, the upper end of the distribution elbow is easily accessible, which facilitates the connection of the distribution elbow to a distribution valve.

The upper end of the distribution elbow is rigidly connected to the cover. Thus, the device is compact and offers a high degree of rigidity which increases its lifespan. As there is no space between the upper end of the distribution elbow and the surface of the cover, the distribution elbow does not have a weak area. Its strength and its lifespan are therefore increased. In addition, the volume of the device is optimised, as the device occupies a reduced amount of space.

According to an aspect of the invention, the lower surface of the cover has a plurality of stiffeners extending radially from the lower end of the distribution elbow. Thus, the thickness of the cover is restricted by using stiffeners that ensure the rigidity of the device. Such stiffeners advantageously allow the weight of the device to be restricted in comparison with an annular connection.

The cover has at least one auxiliary traversing orifice adapted for the passage of a power supply cable for a pump or of a suspension cable. The auxiliary orifice has an internal thread in order to receive a cable gland adapted to block the movement of a cable fitted in said auxiliary orifice. The device has a cable gland screwed into said auxiliary orifice.

The cover has at least one traversing auxiliary orifice formed in a radial stiffener. Thus, the auxiliary orifice has a high degree of structural strength that allows it to guide a pump suspension cable or a pump power supply cable optimally and without wear.

The cover has at least two lower bearing surfaces of different diameters, preferably at least three. Thus, the device can adapt to a plurality of duct diameters. Each lower bearing surface is plane and annular so as to allow stable fitting of the device for a plurality of duct diameters.

The lower bearing surfaces of different diameters are discontinuous.

The cover has a vertical stop wall, associated with each lower bearing surface, adapted to restrict a movement of the cover in a horizontal plane relative to the duct when the cover is bearing against a lower bearing surface.

The cover is annular so as to be compatible with the annular duct.

The lateral walls of the upper end of the distribution elbow are rigidly connected to and orthogonal to the cover. Thus, the upper end is fixed rigidly to the cover while preventing water from flowing between the cover and the upper end of the distribution elbow, which would limit its lifespan.

According to an aspect of the invention, the cover has a vent adapted to allow air to circulate through the cover in order to prevent any mechanical stress produced by a reduction in pressure over the covering device. In other words, a vent provides ventilation for the wellbore. The vent can be removed from the cover.

According to an aspect, the vent has a vertical pipe which can be rigid or flexible.

The invention also relates to an assembly of a covering device as presented above and a seal fitted to the lower bearing surface in such a way that the seal is in contact with the end of the vertical annular duct during use. A seal allows any defect in the planarity of the duct to be rectified so as to have a sealed connection between the cover and the annular duct. A sealed connection prevents foreign elements from being introduced into the duct (dirty water, twigs, etc.) that might affect the wellbore and reduce its lifespan.

The seal has a cone-shaped lower surface adapted to be in contact with the end of the vertical annular duct. A cone-shaped surface makes it possible, in the same way as a plug, to be in contact with the internal wall of the duct in order to create a sealed connection between the cover and the annular duct. In addition, by virtue of the seal, the cover can be fitted horizontally onto the duct, as the quality of the cutting of the duct has no influence on the fitting.

The upper surface of the seal is adapted to cooperate by complementarity of shapes with the lower surface of the covering device so as to prevent both liquid from being trapped between the two parts and play arising between the two parts, which might affect their lifespan. In other words, the covering device and the seal form a single tool.

PRESENTATION OF THE DRAWINGS

The invention will be better understood on reading the description that follows, given solely as an example, and with reference to the accompanying drawings in which.

It should be noted that the drawings explain the invention in a detailed manner in order to implement the invention, said drawings can of course be used to better define the invention where necessary.

DESCRIPTION OF ONE OR MORE EMBODIMENTS

A wellbore duct covering device according to the invention is shown in FIG. 3 to 6.

Figure 1:
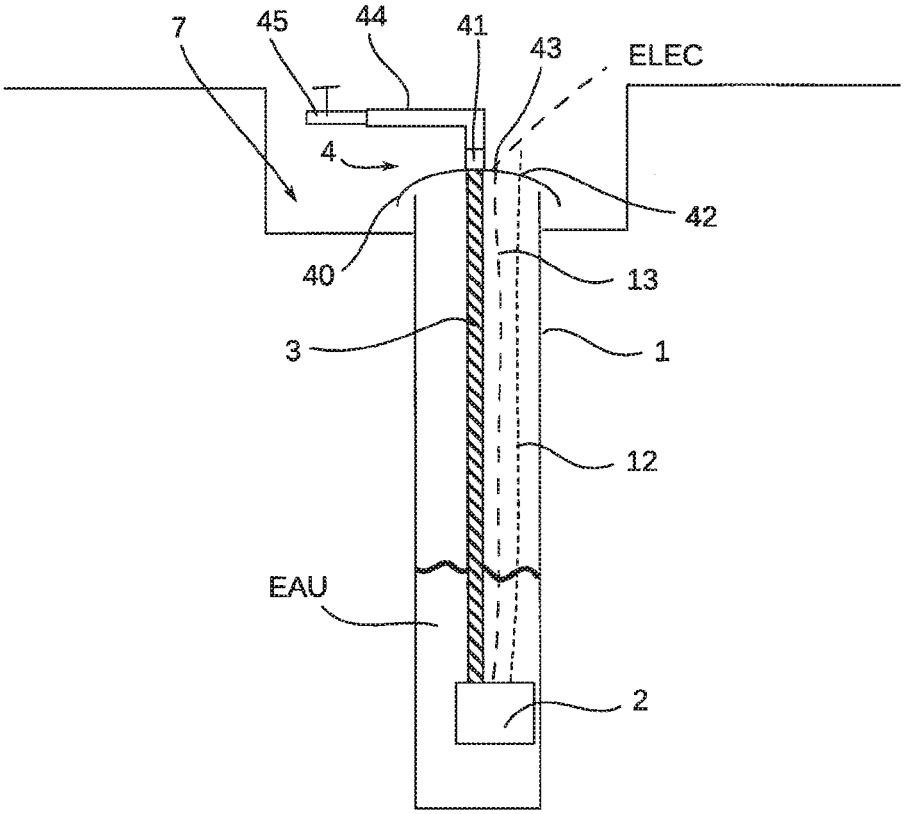
Figure 1 (Prior Art)
FIG. 1 is a schematic view of a covering device according to the prior art in its fitted position on a wellbore duct (already discussed)
Figure 2:
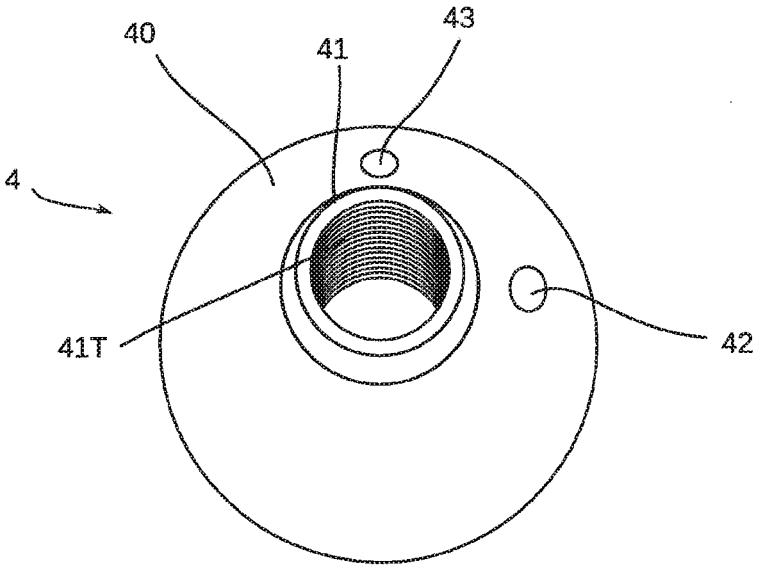
Figure 2 (Prior Art)
FIG. 2 is a perspective view from above of a covering device according to the prior art (already discussed)
Figure 3:
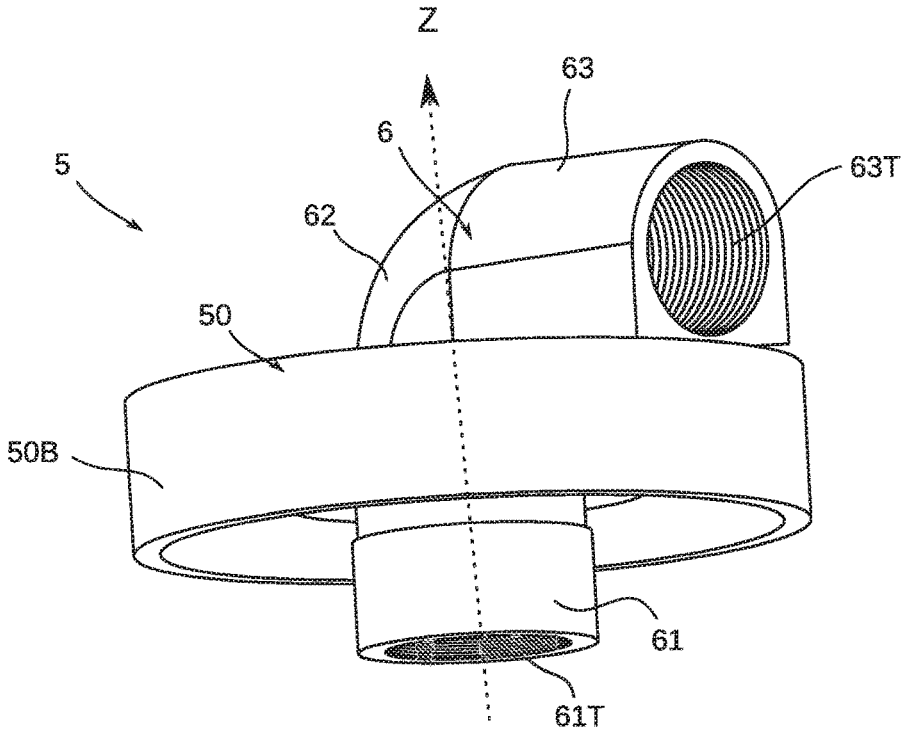
FIG. 3 is a perspective view of a covering device according to the invention.
Figure 4:
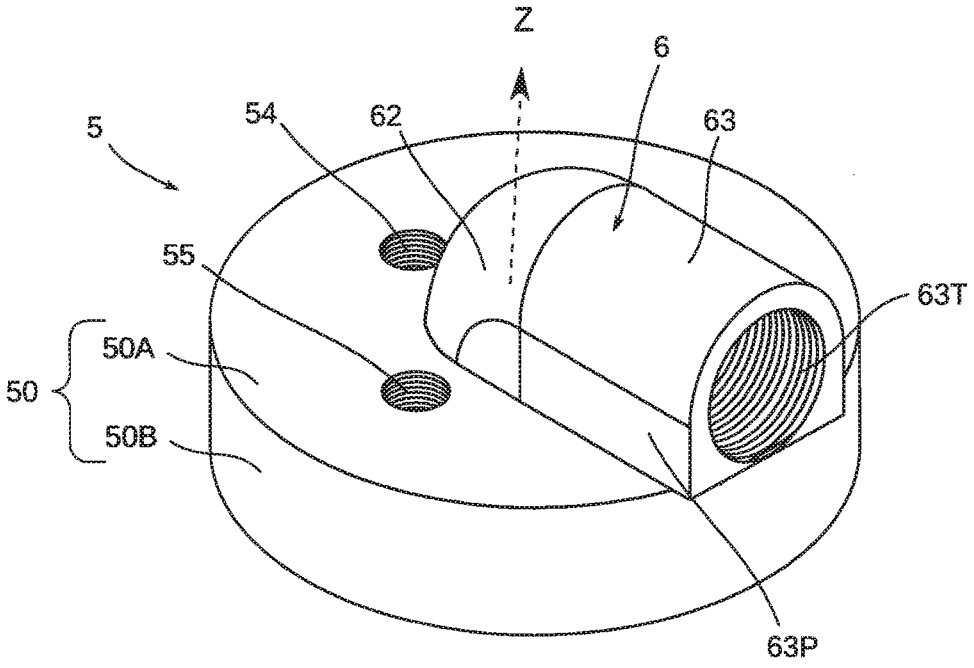
FIG. 4 is another perspective view from above of the covering device of FIG. 3.
Figure 7:
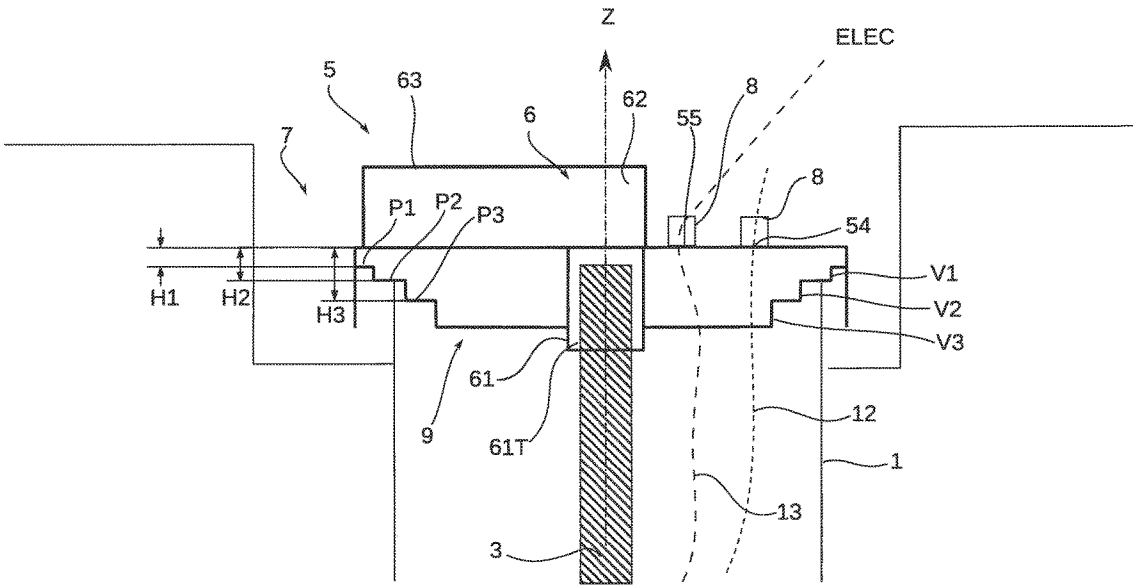
FIG. 7 is another sectional view of the covering device according to the invention in its fitted position on a wellbore duct.

As shown in FIGS. 3 and 4, the covering device 5 has a cover 50 which, in this example, has an annular shape that comprises a plane horizontal upper face 50A which is circular and a vertical cylindrical surround 50B that extends downwards from the periphery of the upper face 50A, the cylindrical surround 50B being orthogonal to the plane upper face 50A. The cover 50 is adapted to be fitted horizontally to an end of a vertical annular duct 1 of a wellbore, as shown in FIG. 7.

Consequently, the vertical direction is defined in relation to an axis Z running orthogonally to the plane horizontal upper face 50A of the cover 50, the axis Z being oriented vertically from the bottom upwards in FIG. 3 to 7.

Still with reference to FIGS. 3 and 4, the covering device 5 has a distribution elbow 6 which comprises a lower end 61, extending vertically downwards from the cover 50, and an upper end 63 extending horizontally from the cover 50. The lower end 61 of the distribution elbow 6 is intended to connect to a line pipe 3 of the wellbore so as to convey the water coming from the line pipe 3 to the upper end 63 of the distribution elbow 6. In other words, the distribution pipe 6 puts the lower surface of the cover 50 in communication with its upper surface, changing by 90° the direction of circulation of the guided flow of water in the distribution elbow 6.

According to the Invention, the distribution elbow 6 is integrated into the cover 50 and forms with it a monobloc assembly, preferably made of ABS-type rigid plastic. A monobloc device 5 of this kind is advantageously obtained by a method of moulding plastic which reduces the cost price and also the weight thereof in comparison with a metal device according to the prior art. Moreover, the integration of the distribution elbow 6 advantageously allows the risk of leaks to be reduced given that the connection between the cover 50 and the distribution elbow 6 is perfectly sealed, the parts being integral from their manufacture. In addition, it is no longer necessary to make a peripheral working cavity 7 of significant dimensions around the duct 1 so that the well-digger can manipulate and move the distribution elbow 6, said distribution elbow being directly integrated into the cover 50.

In this example, still with reference to FIGS. 3 and 4, the distribution elbow 6 has a curved portion 62 situated on the upper surface of the cover 50 that connects the vertical lower end 61 to the horizontal upper end 63 so as to form an L. The distribution elbow 6 has, internally, a cavity with a circular cross section in which the flow of water from the line pipe 3 can circulate.

In order to allow the distribution elbow 6 to be connected to a line pipe 3 or to a connector (not shown), the lower end 61 has an internal thread 61T. Similarly, the upper end 63 of the distribution elbow 6 has an internal thread 63T to allow connection to a distribution valve (not shown).

Figure 5:
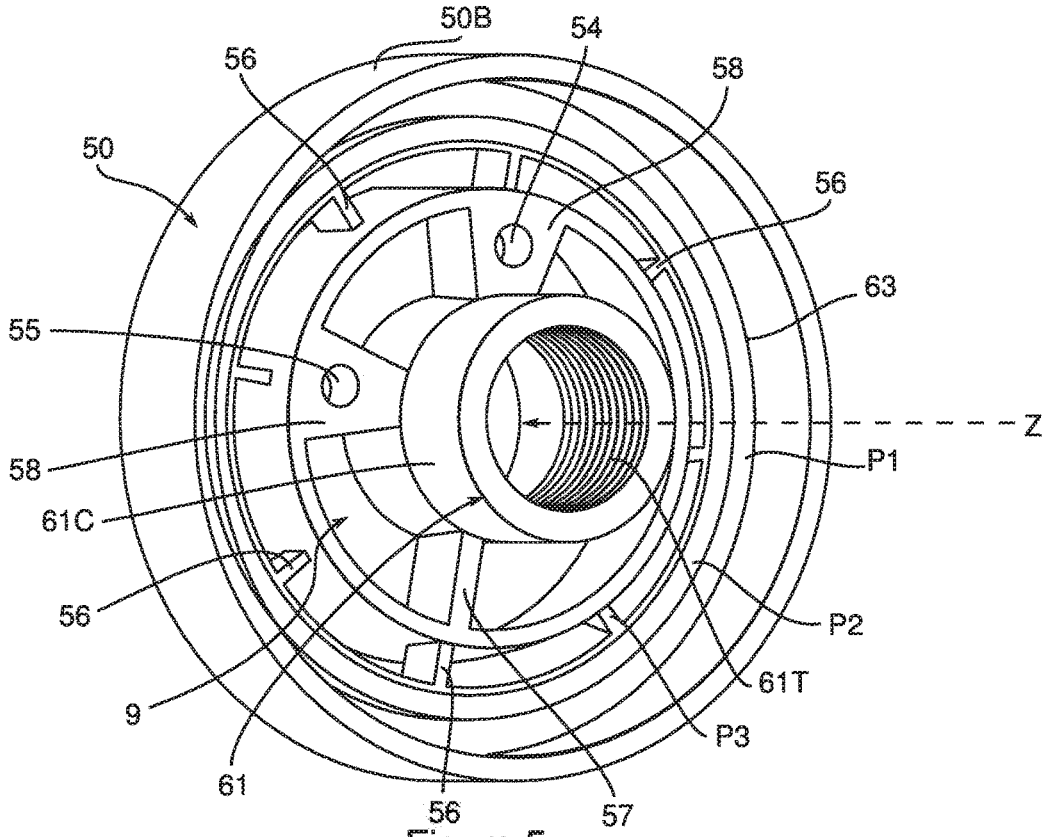
FIG. 5 is a perspective view from below of the covering device of FIG. 3.

As shown in FIG. 5, the lower end 61 of the distribution elbow 6 extends from the centre of the cover along the vertical axis Z. The upper end 63 of the distribution elbow 6 is rigidly connected to the plane horizontal surface 50A of the cover 50 as shown in FIG. 4. In other words, there is no space between the upper end 63 of the distribution elbow 6 and the plane horizontal surface 50A of the cover 50. In this example, the upper end 63 of the distribution elbow 6 has lateral walls 63P that are orthogonal to the cover 50 so as to reinforce the connection between the distribution elbow 6 and the cover 50 while facilitating the manufacture of the device 5 by moulding.

The upper end 63 of the distribution elbow 6 extends to the periphery of the cover 50, in other words, at right-angles to the surround 50B of the cover, in order to facilitate its connection to a valve while avoiding the formation of a projecting portion which would increase the space occupied by the device 5.

According to the invention, the covering device 5 has two auxiliary orifices 54, 55 which traverse the upper face 50A of the cover 50 and which respectively allow an electrical power supply cable 13 and a suspension cable 12 to pass through, as will be shown later with reference to FIG. 7. Preferably, the auxiliary orifices 54, 55 are threaded so as to allow a sealed screw-fitting of a cable gland 8 having a hollow cylindrical body with a threaded fixing end and a free locking end adapted to fix the position of a cable 12, 13 traversing its cylindrical body. Thus, once screwed into an auxiliary orifice 54, 55, each cable gland 8 fixes the cables 12, 13 to the covering device 5, in a rigidly connected and sealed manner, preventing said cables from sliding within the auxiliary orifices 54, 55. Advantageously, the well-digger can move the device 5 with the cables 12, 13 with one hand, allowing them to use their other hand, for example, to fix the line pipe 3 to the covering device 5, which accelerates the installation of the wellbore.

Figure 6:
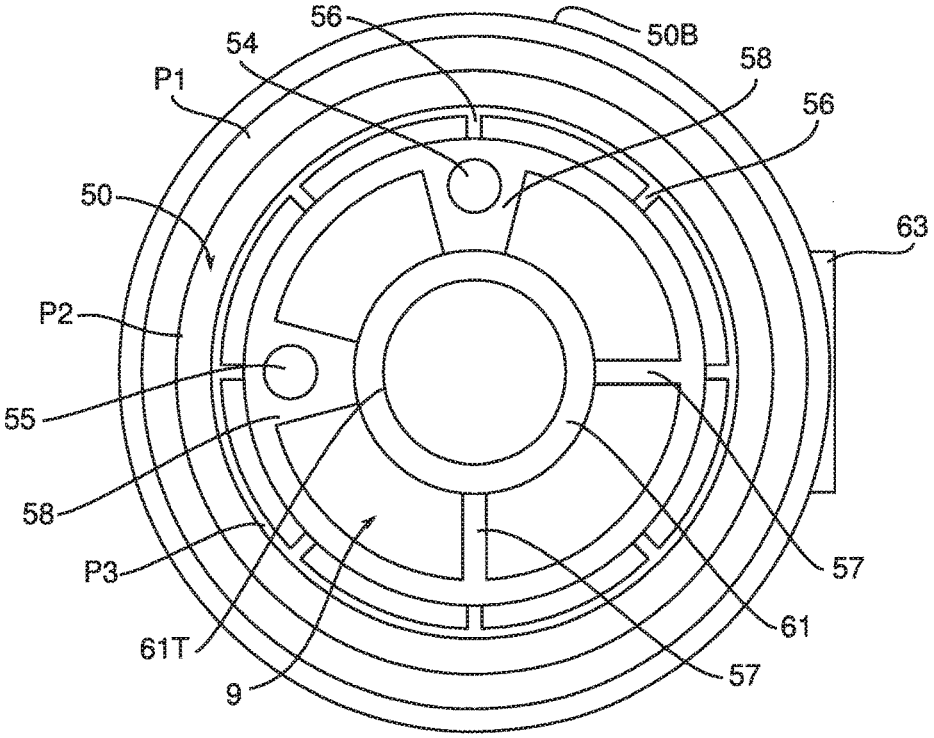
FIG. 6 is another perspective view from below of the covering device of FIG. 3.

The lower surface of the covering device 5 will now be presented in detail, with reference to FIGS. 5 and 6.

In this example, the cover 50 comprises a plurality of plane lower bearing surfaces P1, P2, P3 that are intended to come into contact with the end of a wellbore duct 1. The bearing surfaces P1, P2, P3 take the form, in this example, of horizontal annular rings of different diameters. The bearing surfaces P1, P2, P3 are concentric and centred on the axis Z along which the lower end 61 of the distribution elbow 6 extends.

In this example, bearing surfaces P1, P2, P3 have diameters of approximately 145 mm, 135 mm and 125 mm respectively. In this example, each bearing surface P1, P2, P3 has a radial dimension of approximately 5 mm. Thus, ducts of intermediate diameters can be covered in a stable manner by the device according to the invention. The bearing height H, that is, the vertical distance defined along the vertical axis Z that separates a bearing surface P from the plane face 50A of the cover 50, is different for each bearing surface P1, P2, P3. Thus, the bearing height Hi of the bearing surface P1 is less than that of the bearing surface P2 which is itself less than that of the bearing surface P3, as shown in FIG. 7. In other words, the bearing surfaces P1, P2, P3 are a series of steps.

The cover 50 has a vertical stop wall V1, V2, V3 associated with each lower bearing surface P1, P2, P3 to restrict a movement of the cover 50 in a horizontal plane relative to the duct 1 when the cover 50 is bearing against a lower bearing surface P1, P2, P3. As shown in FIG. 7, each lower bearing surface P1, P2, P3 is delimited radially and internally by a vertical stop wall V1, V2, V3 which provides stability in the event of an impact or vibrations.

Advantageously, the lower bearing surface P1 is radially delimited externally by the surround 50B and internally by the vertical stop wall V1. Thus, if the duct 1 has a diameter of approximately 145 mm, said duct is in contact with the bearing surface P1 and is blocked laterally by the vertical wall V1 and by the surround 50B. Thus, any horizontal movement of the covering device 5 is prevented, which improves stability during use thereof.

Likewise, if the duct 1 has a diameter of approximately 135 mm, said duct is in contact with the bearing surface P2 and is blocked laterally by the vertical wall V2 situated between the bearing surfaces P2 and P3. Moreover, if the duct 1 has a diameter of approximately 125 mm, said duct is in contact with the bearing surface P3 and is blocked laterally by the vertical wall V3.

With reference to FIG. 5 to 7, the lower surface of the cover 50 has a base 9 between the lower end 61 of the distribution elbow 6 and the annular bearing surface P3. The base 9 is annular and is traversed by the auxiliary orifices 54, 55 as shown above. In this example, as shown in FIG. 7, the bearing height of the base 9 is greater than that of the bearing surface P3 so as to form a step.

With reference to FIG. 5, the external surface 61C of the lower end 61 is notched so as to allow optimal tightening of the line pipe 3 in the internal thread 61T of the lower end 61, for example, by means of an adjustable spanner or manually. The presence of notches improves the grip when the line pipe 3 is tightened and allows a strong, sealed connection to be formed.

The greater the bearing height H, the more material the covering device 5 has and the greater its weight. Therefore, in order to make the covering device 5 lighter and reduce its cost of manufacture, the bearing surface P3 and the base 9 are partially hollowed out so as to create radial stiffeners 56, 57, 58 on the lower surface of the covering device 5 as shown in FIG. 6. Such stiffeners 56, 57, 58 allow the device 5 to be made lighter while giving it a high degree of stiffness. Preferably, the stiffeners 56, 57, 58 are distributed angularly in order to give a uniform stiffness.

With reference to FIG. 6, the bearing surface P3 has eight stiffeners 56 distributed angularly, each stiffener 56 having the same bearing height H3 as the bearing surface P3. Thus, if the duct 1 has a diameter of 125 mm, said duct makes contact with the surface of the stiffeners 56.

With reference to FIG. 6, the base 9 has two single stiffeners 57 and two thickened stiffeners 58 in which the auxiliary orifices 54, 55 respectively extend. A thickened stiffener 58 allows the forces applied to the auxiliary orifices 54, 55 to be borne structurally, for example by the suspension cable 12 and the electrical power supply cable 13.

Figure 11:
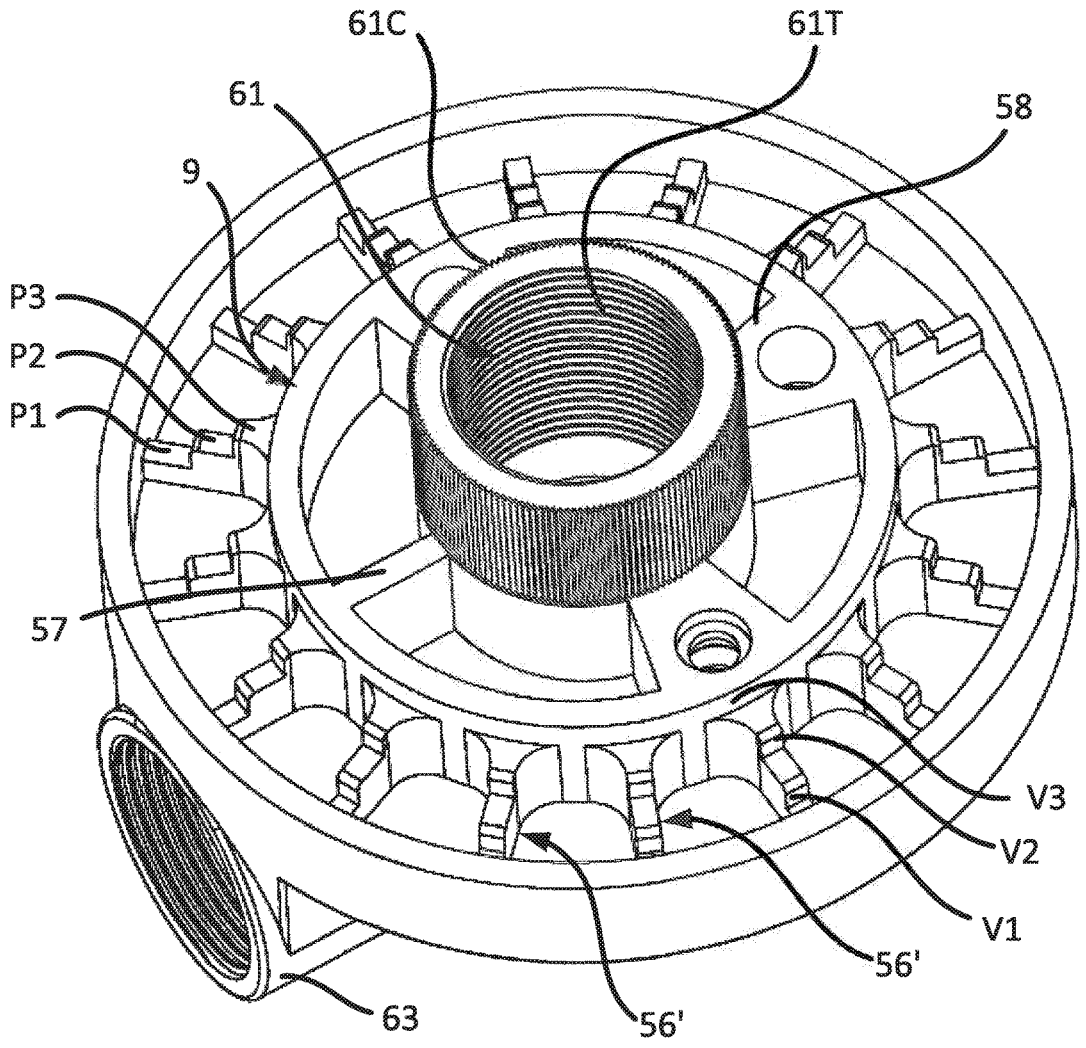
FIG. 11 is a perspective view from below of another embodiment of the covering device of the invention.

According to another embodiment of the invention, with reference to FIG. 11, the bearing surfaces P1, P2, P3 are discontinuous. In this example, the bearing stiffeners 56' are formed on the lower surface of the cover between the base 9 and the surround 50B. The bearing stiffeners 56' extend radially and each is shaped like a set of steps, as shown in FIG. 11, so as to define the bearing surfaces P1, P2, P3. This embodiment is particularly advantageous because it restricts the weight of the device while facilitating its manufacture. In addition, a discontinuous bearing surface improves stability, given that the cover is in contact only with a few points of the tubular duct. A discontinuous annular bearing surface is formed from a plurality of separate elementary bearing surfaces that together form an overall surface with an annular shape.

An embodiment of the invention will now be described with reference to FIG. 7. The covering device 5 is fitted at the upper end of a wellbore duct 1 which is preferably made of PVC. In this example, a distribution pump (not shown) is situated at the bottom of the well and is connected to a line pipe 3. The distribution pump 2 is connected to both a suspension cable 12 and to a power supply cable 13.

To put the covering device 5 in place, the well-digger inserts the suspension cable 12 from bottom to top in the auxiliary orifice 54 and locks it in position with the cable gland 8 fitted in said orifice 54. They repeat the operation with the power supply cable 13 so that the covering device 5 is rigidly connected to the cables 12, 13. The electrical power supply cable 13 is connected at the upper part to a source of electrical energy, for example an electrical socket.

Using one hand, the well-digger can hold the covering device 5 with the cables 12, 13. Advantageously, they can fix the line pipe 3 with their other hand without risking the cables 12, 13 falling to the bottom of the wellbore. In addition, as the cables 12, 13 are guided in thickened stiffeners 58, the covering device 5 has sufficient rigidity to bear the weight of the pump. Finally, as the upper surface 50A of the cover 50 is plane, each cable 12, 13 extends longitudinally in its auxiliary orifice 54, 55 without risk of pinching.

In this example, the duct 1 has a diameter of 135 mm. Thus, the device 5 rests on the upper end of the duct 1 in accordance with the bearing surface P2 of the covering device 5 as shown in FIG. 7. The vertical stop wall V2 situated between the bearing surfaces P2 and P3 advantageously prevents any horizontal movement of the covering device 5.

The upper end of the line pipe 3 cooperates with the internal thread 61T of the lower end 61 of the distribution elbow 6 by screwing so as to produce a sealed connection for conveying the flow of water from the line pipe 3 towards the upper end 63 of the distribution elbow with a view to its distribution.

The placing of a covering device 5 according to the invention accelerates the production of a well which is very advantageous. In addition, because of its compactness and the integration of the distribution elbow 6 into the cover 50, the dimensions of the peripheral working area can be reduced, which provides an improvement. Furthermore, a covering device 5 made of plastic has a longer lifespan because of its resistance to corrosion and to electrolysis phenomena.

A second embodiment of the invention is described with reference to FIG. 8. Elements whose structure or function is identical, equivalent or similar to those of the elements in FIG. 4 are referenced using the same references, to simplify the description. Moreover, the whole of the description of the embodiment of FIG. 4 is not repeated, as this description applies to the elements of FIG. 8 where there are no incompatibilities. Only the noteworthy structural and functional differences are described.

Figure 8:
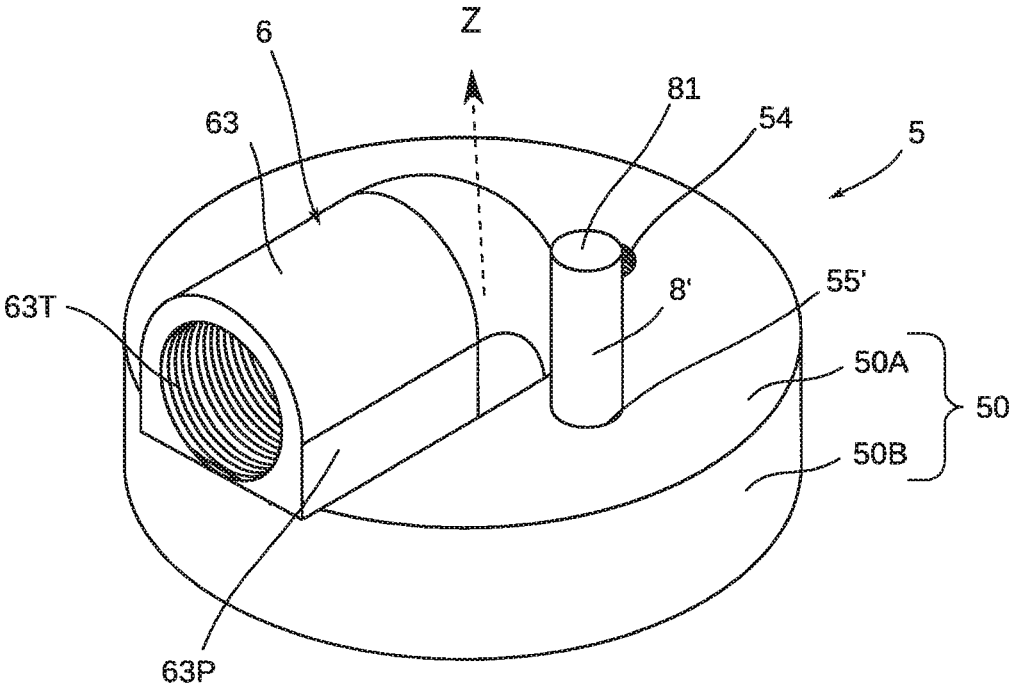
FIG. 8 is a perspective view from above of a second embodiment of the covering device with a vent.

With reference to FIG. 8, the covering device 5 has three auxiliary orifices 54, 55, 55' which traverse the upper face 50A of the cover 50 and which respectively allow the passage through of an electrical power supply cable 13, the passage through of a suspension cable 12 and the fixing of a vent 8'. Preferably, the auxiliary orifices 54, 55, 55' are threaded internally so as to allow sealed screw-fitting of a cable gland 8 or a vent 8'. In this example, the vent 8' takes the form of a tubular pipe extending vertically and adapted to allow a flow of air to circulate between the interior and the exterior of the wellbore. The vent 8' has at its lower end a thread such that it corresponds with the internal thread of the auxiliary orifices 54, 55, 55' that traverse the upper face 50A of the cover 50.

The vent 8' takes the form of a single pipe (or a straw) that is fixed in a cable gland 8 fitted in one of the auxiliary orifices 54, 55, 55' that traverses the upper face 50A of the cover 50. In other words, the vent 8' does not have fixing means and is removable. The auxiliary orifice 55' has a stop to block the vertical translation of the vent 8', the cable gland 8 locking and sealing the assembly. A removable vent 8' makes it possible to adapt to the conditions of use of the wellbore. The vent 8' can take the form of a flexible or rigid pipe depending on the conditions of use of the wellbore.

The vent 8' is an accessory of the covering device 5 which can be fixed rapidly to the cover 50 to prevent a reduction in pressure in the bore. This is because if the covering device 5 was perfectly sealed, a reduction in the level of water in the wellbore could create a reduction in pressure in the wellbore and put stress on the duct 1 which would affect the bore assembly and restrict its lifespan. The addition of a vent 8' makes it possible to guard against this risk. In addition, in the event of flooding, the access orifice 81 of the vent 8' is situated above the level of the cover 50 which prevents rainwater from entering the wellbore directly. Preferably, the access orifice 81 of the vent 8' leads into a healthy environment which is unlikely to be polluted.

The vent 8' can advantageously be removed from the cover 50 in order to adapt to the largest number of situations. The vertical length of the vent 8' can be adapted according to the type of bore terrain. As an example, marshy terrain requires a vent 8' of a significant length in order to prevent any liquid from being introduced into the wellbore in the event of heavy flooding.

Figure 10:
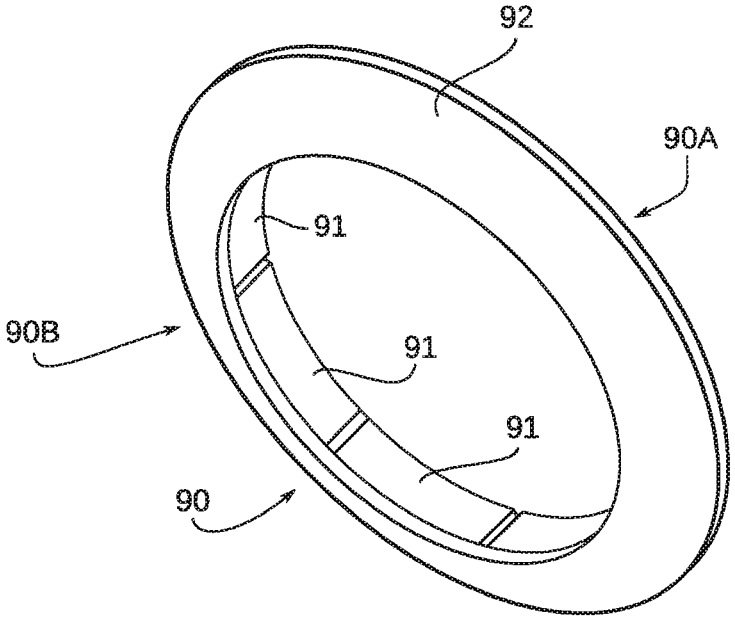
FIG. 10 is an enlarged perspective view of the seal of FIG. 9.
Figure 9:
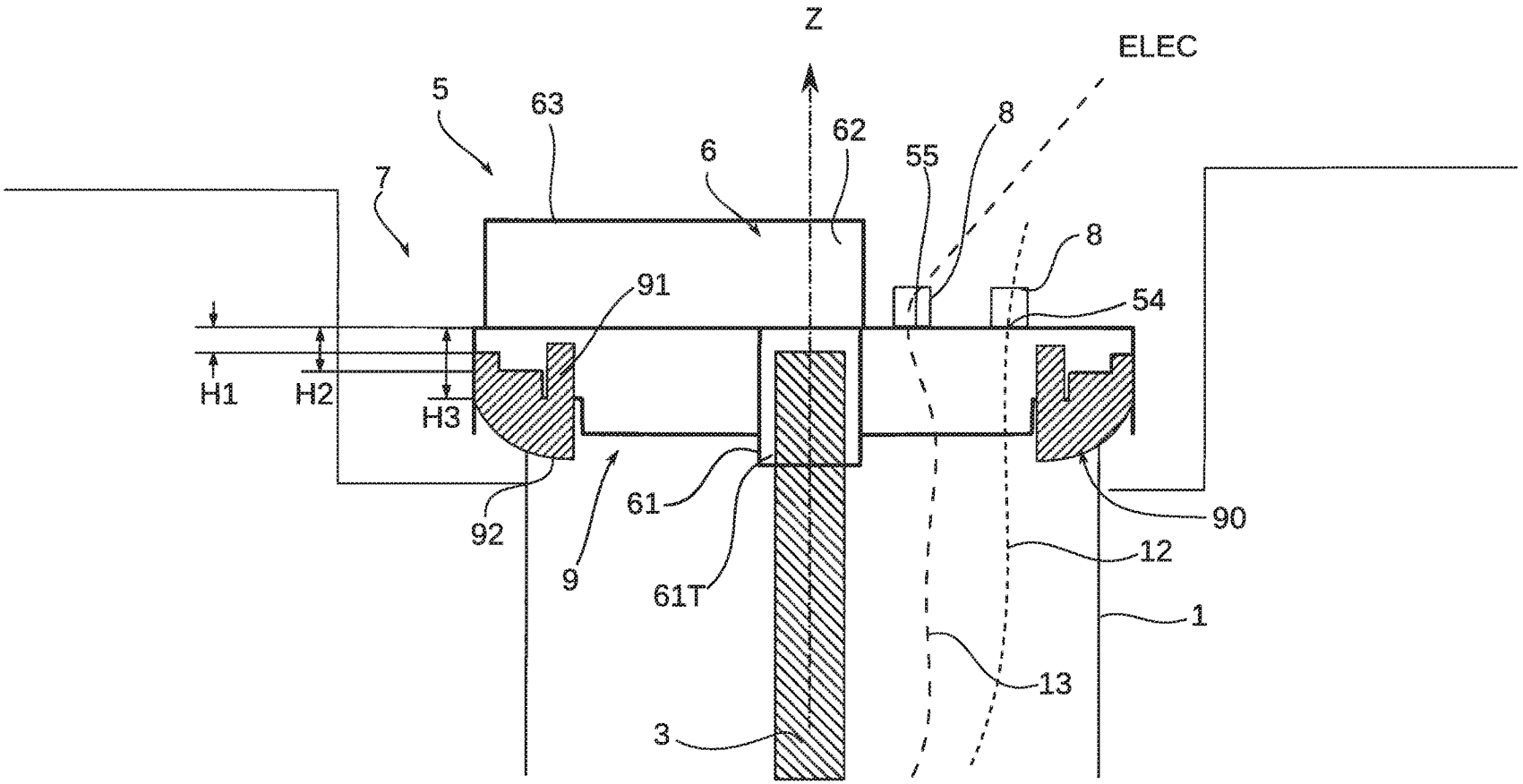
FIG. 9 is a sectional view of the covering device according to the invention in its fitted position on a wellbore duct with a seal.

The invention also covers the association of a covering device 5 as presented above with a seal 90 as shown in FIGS. 9 and 10.

A seal 90 is an accessory of the covering device 5 that is fixed to the lower part of the cover 50 in order to cooperate with the upper edges of the duct 1 during the fitting of the device 5 as shown in FIG. 9.

With reference now to FIG. 10, the seal 90 takes the form of an annular ring that has an upper face 90A adapted to be fitted against the lower face of the cover 50 and a lower face 90B adapted to be in contact with the edge of the duct 1.

With reference to FIG. 10, the upper face 90A has a plurality of curvilinear mounting tongues 91, extending vertically, which are adapted to enter the space created between two consecutive stiffeners 56 of the cover 50. In other words, each mounting tongue 91 extends between the vertical stop walls V2, V3 in order to be fixed to the cover 50. Preferably, the seal 90 is force-fitted to the covering device 5 in order to be joined to it. In this example, the upper surface 90A of the seal 90 is adapted to cooperate by complementarity of shapes with the lower surface of the covering device 5. Advantageously, the upper surface 90A of the seal 90 has an adhesive portion so as to improve the connection with the cover 50.

The seal 90 consists of a deformable material, preferably a medium- or high-density waterproof plastic foam. Advantageously, the foam of the seal 90 retracts once it is fitted to the duct 1 because of the weight of the covering device 5 and of the items of equipment to which said device is connected.

As shown in FIG. 9, the upper face 90A of the seal 90 has a stepped cross section so as to cooperate with the bearing surfaces P1, P2 of the lower surface of the covering device 5.

With reference to FIGS. 9 and 10, the lower face 90B of the seal 90 has a conical annular surface 92 which is advantageous for its fitting in the duct 1. This is because a conical surface 92 makes it possible to compensate for all the defects in the cutting of the duct 1 so that there can be a sealed fitting in the manner of a plug. As an example, if the cutting of the duct 1 is not performed in a plane transverse to the axis Z of the duct 1, the edge of the duct has an irregular shape and not a circular shape. The conical surface 92 of the seal 90 advantageously allows it to remain in contact with the irregular edge of the duct 1 which ensures a sealed fitting. Advantageously, the foam of the seal 90 also helps to reduce the irregularities of the cutting of the duct 1 so that the cover 50 can be fitted horizontally.

When the foam of the seal 90 retracts, it allows the outline formed by the stepped bearing surfaces P1, P2, P3 of the cover 50 to appear so that the covering device can adapt to any diameter of duct 1. In other words, the density of the foam is chosen so as to achieve a compromise between a significant deformation that allows the formation of bearing surfaces P1, P2, P3 in steps and a limited deformation that provides a seal by toning down the Irregularities of the cutting.

As an example, for a covering device whose weight is approximately 80 to 100 kg with its items of equipment (pump, etc.), a seal 90 whose volume density is included in the range between 65 kg/cm$^3$ and 195 kg/cm$^3$, such as approximately 130 kg/cm$^3$, and whose Shore hardness value is included in the range between 25 and 55, such as approximately 35, provides a good compromise.

In other words, the combination of a seal 90 made of foam and having a conical surface makes it possible to seal the connection between the covering device 5 and the duct 1 and to do so regardless of the quality of the cutting of the duct 1. Furthermore, a horizontal fitting of the cover 50 is obtained for any duct 1, regardless of its diameter.

The invention claimed is:

1. A device for covering a wellbore duct comprising:

a cover having at least one lower bearing surface suitable for being fitted onto an end of a vertical annular duct of a wellbore; and a distribution elbow with a lower end connectable to a line pipe of the wellbore, the lower end extending vertically downwards from the cover and an upper end of the elbow, the elbow being rigidly connected to the cover and extending horizontally such that the cover and the elbow form a monobloc assembly;

wherein the lower bearing surface of the cover has a plurality of stiffeners extending radially from the lower end of the distribution elbow.

2. The device according to claim 1, wherein the lower bearing surface is plane and horizontal.

3. The device according to claim 1, wherein the monobloc assembly is made of rigid plastic.

4. The device according to claim 1, wherein the cover has an upper plane horizontal surface.

5. The device according to claim 1, wherein the upper end of the distribution elbow extends as far as the periphery of the cover.

6. The device according to claim 1, wherein the cover has at least one auxiliary traversing orifice formed in a radial stiffener.

7. The device according to claim 1, wherein the cover has at least two lower bearing surfaces of different diameters.

8. The device according to claim 1, wherein the cover is annular.

9. The device according to claim 1, wherein the cover has a vent adapted to allow air to circulate through the cover.

10. The device according to claim 9, wherein the vent has a vertical pipe.

11. The device according to claim 1 assembled with a seal fitted to the lower bearing surface in such a way that the seal is in contact with the end of the vertical annular duct during use.

12. The device according to claim 11, wherein the seal has a cone-shaped lower surface adapted to be in contact with the end of the vertical annular duct.

13. The device according to claim 11, wherein an upper surface of the seal is adapted to cooperate by complementary shapes with the lower surface of the covering device.

* * * * *